US006200052B1

(12) United States Patent
Pitaniello

(10) Patent No.: US 6,200,052 B1
(45) Date of Patent: Mar. 13, 2001

(54) BALANCING PEN

(76) Inventor: Kristina Pitaniello, 46 Waltham St., Studio 309, Boston, MA (US) 02118

( * ) Notice: Subject to any disclaimer, the term of this patent is extended or adjusted under 35 U.S.C. 154(b) by 0 days.

(21) Appl. No.: 09/345,049

(22) Filed: Jun. 30, 1999

Related U.S. Application Data

(63) Continuation-in-part of application No. 09/080,337, filed on May 15, 1998, now abandoned.

(51) Int. Cl.[7] ..... B43K 23/02
(52) U.S. Cl. ..... 401/131; 401/243; 401/246
(58) Field of Search ..... 401/131, 88, 98, 401/243, 246, 247, 52, 195; 211/69.5

(56) References Cited

U.S. PATENT DOCUMENTS 831,394 * 9/1906 Webb ..... 401/131
5,454,654 * 10/1995 Bergstrom ..... 401/131

FOREIGN PATENT DOCUMENTS

27926 * 11/1909 (FR) ..... 401/131
849588 * 11/1939 (FR) ..... 401/131

* cited by examiner

*Primary Examiner*—David J. Walczak
(74) *Attorney, Agent, or Firm*—Hale and Dorr LLP

(57) ABSTRACT

A pen or other writing instrument has a cap with a bulb that is relatively heavy compared to the barrel of the pen and has a larger diameter. The bulb has an approximately oval outer shape and may include a tube for receiving the pen or an outer ring. When placed or tossed onto a desk or table, the cap causes the pen to remain standing, where it is easily located. The cap can be formed as a single piece.

22 Claims, 4 Drawing Sheets

BALANCING PEN

CROSS-REFERENCE TO RELATED APPLICATION

This is a continuation-in-part of U.S. patent application Ser. No. 09/080,337, filed May 15, 1998, now abandon.

FIELD OF THE INVENTION

This invention relates to writing instruments and, more particularly, to caps for pens and other writing instruments.

BACKGROUND OF THE INVENTION

A typical pen has a barrel that surrounds an ink cartridge and a cap that covers the point of the pen. When closed, the pen has an approximately cylindrical shape.

When a user finishes with the pen, it may be placed in a desk drawer or, commonly, tossed onto the top of a desk. While various stands and holders exist for pens, those tend to be large and to be pre-positioned on one part of a desk. Although movable, they are not always conveniently located when a user is finished using the pen.

When placed on a desk, a pen has little height and is easily lost among the papers and files already on the desk.

SUMMARY OF THE INVENTION

According to the present invention, a pen or other writing instrument is provided with a cap with a bulb at the end that is relatively heavy compared to the barrel of the pen. When placed or tossed onto a desk or table, the bulb causes the pen to remain standing, where it is easily located.

The bulb may be formed integrally with the cap or as a separate piece. The cap can be sold with the pen, in place of a conventional cap, or as a replacement cap for a pen.

DETAILED DESCRIPTION OF PREFERRED EMBODIMENTS

Figure 1:
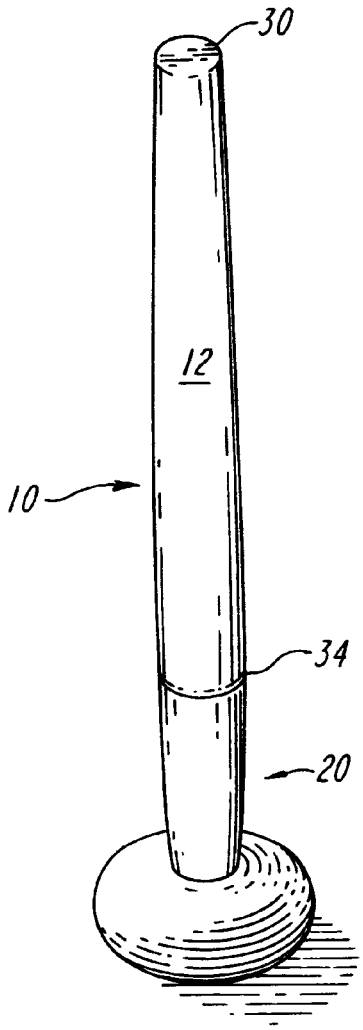
FIG. 1 is a perspective side view of a pen according to a first embodiment of the present invention.

Referring to FIGS. 1–4, which show a first embodiment of the present invention, pen 10 includes barrel 12, cartridge 16, and cap 20. When closed, pen 10 is approximately 5 inches long. However, the size of the pen can be modified for appearance and as appropriate for the materials used to make the pen.

Barrel 12 is formed from a styrene-based resin or plastic, and is a hollow tube that is closed at back end 30 and open at front end 34. Preferably, barrel 12 is widest at front end 34 and tapers toward back end 30. In a preferred embodiment, barrel 12 is approximately 9 millimeters wide at front end 34 and approximately 8.2 millimeters wide at back end 30. Other shapes for barrel 12 may also be used.

Front end 34 of barrel 12 is threaded internally to receive cartridge 16. Alternatively, barrel 12 can include a separate ring that is inserted into front end 34 of barrel 12, with the ring having internal threads to receive cartridge 16.

Cartridge 16 includes a reservoir holder 42, which holds an ink reservoir (not shown) and a writing portion, which includes point or nib 46. Preferably, reservoir holder 42 is made from plated brass and cartridge 16 is for a ballpoint or rollerball type pen. Alternatively, a fountain pen can be used. Reservoir holder 42 is threaded on its outside to permit it to be screwed into front end 34 of barrel 12. In a preferred embodiment, reservoir holder 42 is approximately 17 millimeters long and approximately 9 millimeters in diameter.

Cap 20 has a back (frist) end an a front (second) end, and includes hollow tube 50 and solid bulb 52. Tube 50 has an opening at the back (first) end 60 with a first diameter and is connected to bulb 52 at the front (second) end, opposite the back (first) end. Bulb 52, having a second diameter, is connected to the front (second) end of the tube 50 at an instrument (third) end and has an approximately oval front side at a bottom (fourth) end, opposite the instrument (third) end. In one embodiment, tube 50 and bulb 52 are formed from a single piece of brass or lead-based brass. Alternatively, tube 50 and bulb 52 are formed from separate materials, such as lead-based brass for bulb 52 and aluminum or an aluminum or other metal-lined plastic for tube 50. Where, for example, tube 50 is made from metal, the inner portion of tube 50 may be threaded to fit threads at the end of a cylindrical sheath, which is formed from plastic and fits within tube 50. Tube 50 is tapered at its front, toward bulb 52. Where tube 50 and bulb 52 are formed from separate materials, the plastic inner portion 18 of tube 50 (or its internal sheath) extends beyond the metal outer portion 56 and is threaded for insertion of tube 50 into bulb 52. Cartridge 16 fits against the plastic inner portion 18 of tube 50 to close pen 10. When closed, cartridge 16 is held firmly by plastic inner portion 18, but cartridge 16 can be pulled from tube 50 to open pen 10. Alternatively, cartridge 16 can be screwed to tube 50. In a preferred embodiment, cap 20 is approximately 35–40 millimeters long, and tube 50 is approximately 27 millimeters long and 9 millimeters in diameter before the tapering. Bulb 52 is approximately 24 millimeters in diameter at its widest point. Alternatively, bulb 52 can have a larger or smaller diameter relative to the diameter of tube 50, and typically will be at least twice the diameter of tube 50. Generally, a larger diameter for bulb 52 will increase the angle for which pen 10 will remain standing.

When pen 10 is closed, the open end 60 of tube 50 meets the front end 34 of barrel 12.

Bulb 52 is sufficiently large that most of the weight of pen 10 is in bulb 52.

Figure 2:
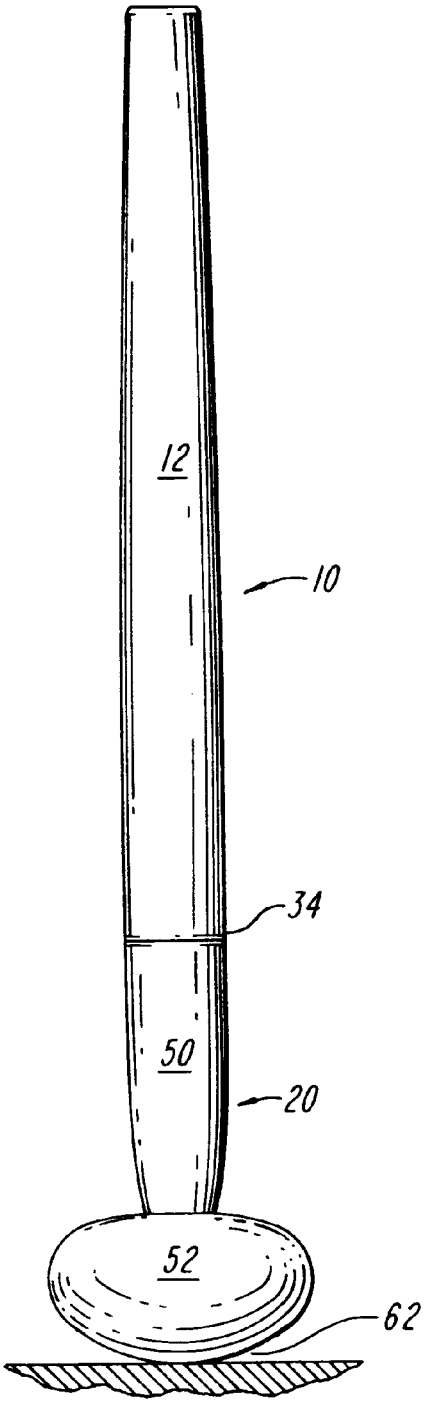
FIG. 2 is a side elevational view of a pen according to the first embodiment of the present invention.
Figure 3:
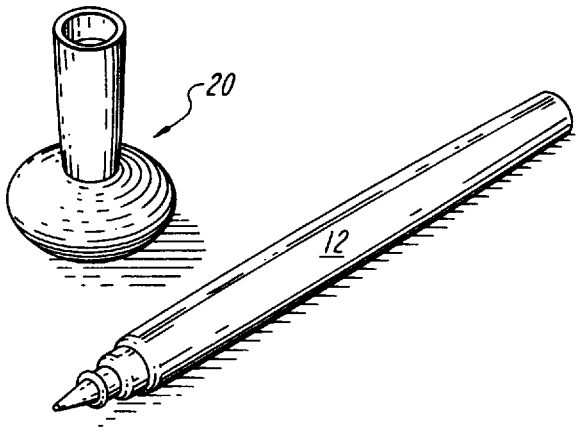
FIG. 3 is a perspective side view of a pen according to the first embodiment of the present invention with the cap separated from the pen.
Figure 4:
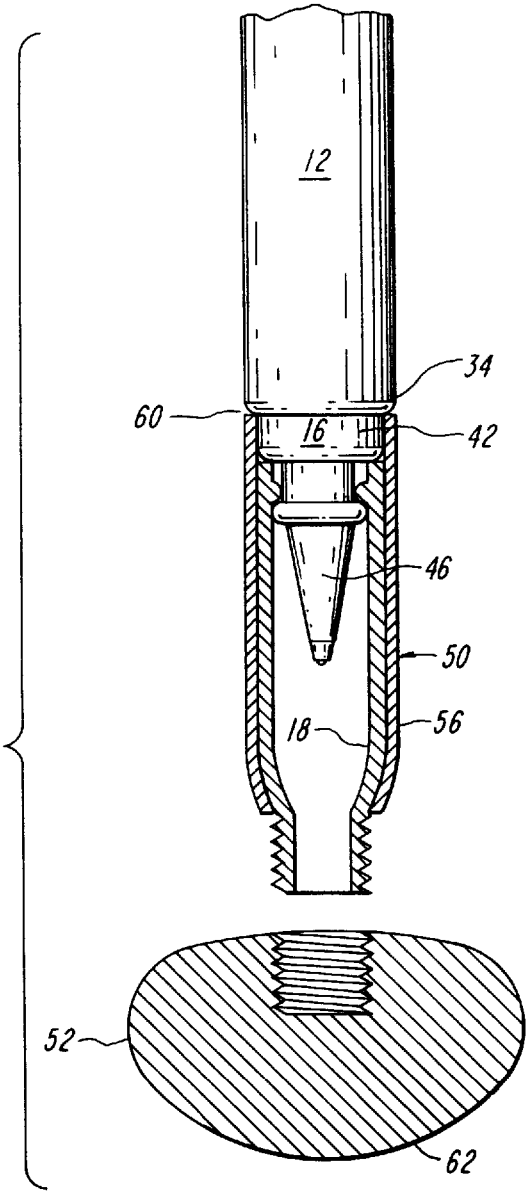
FIG. 4 is a partially cut-away, partially exploded side elevational view of a pen according to the first embodiment of the present invention.
Figure 5:
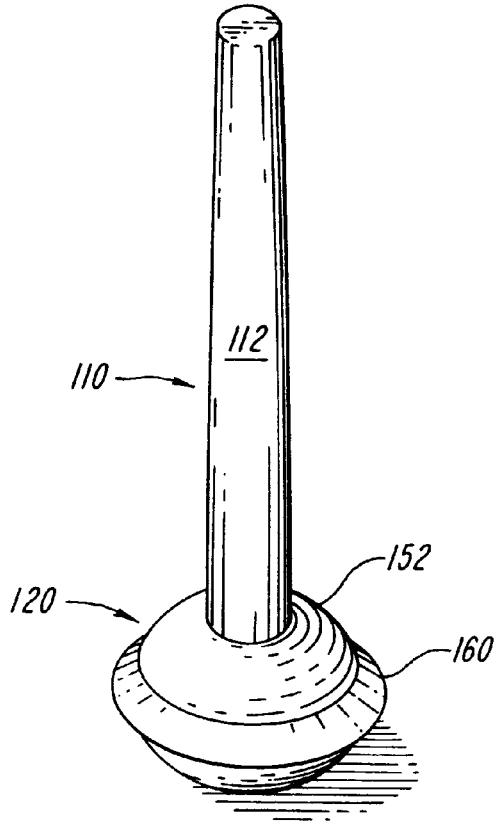
FIG. 5 is a perspective side view of a pen according to a second embodiment of the present invention.
Figure 6:
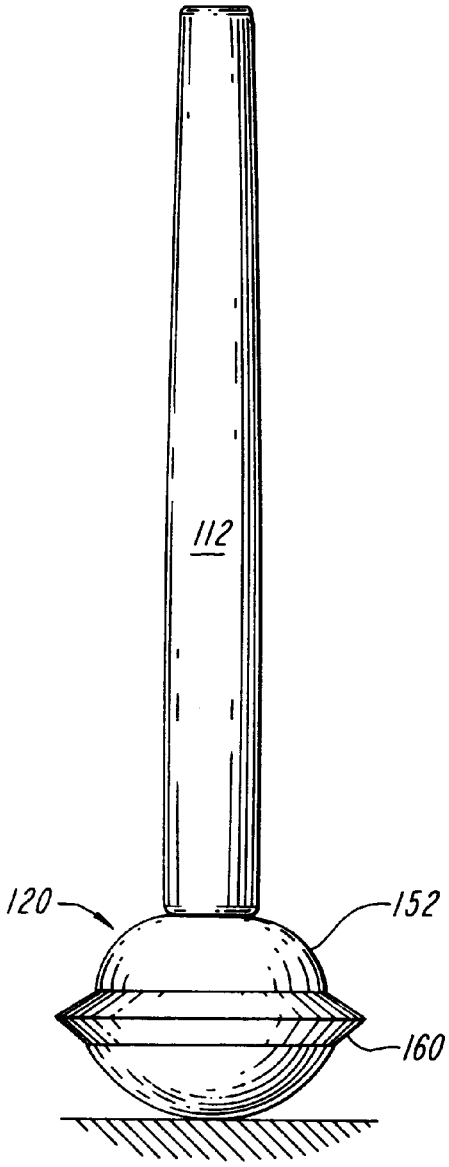
FIG. 6 is a side elevational view of a pen according to the second embodiment of the present invention.
Figure 7:
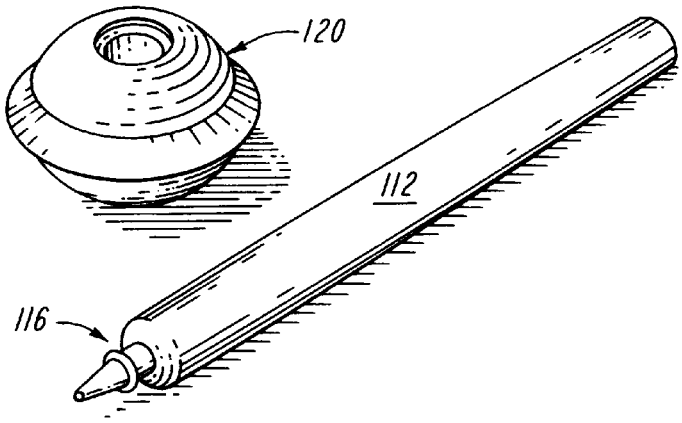
FIG. 7 is a perspective side view of a pen according to the second embodiment of the present invention with the cap separated from the pen.
Figure 8:
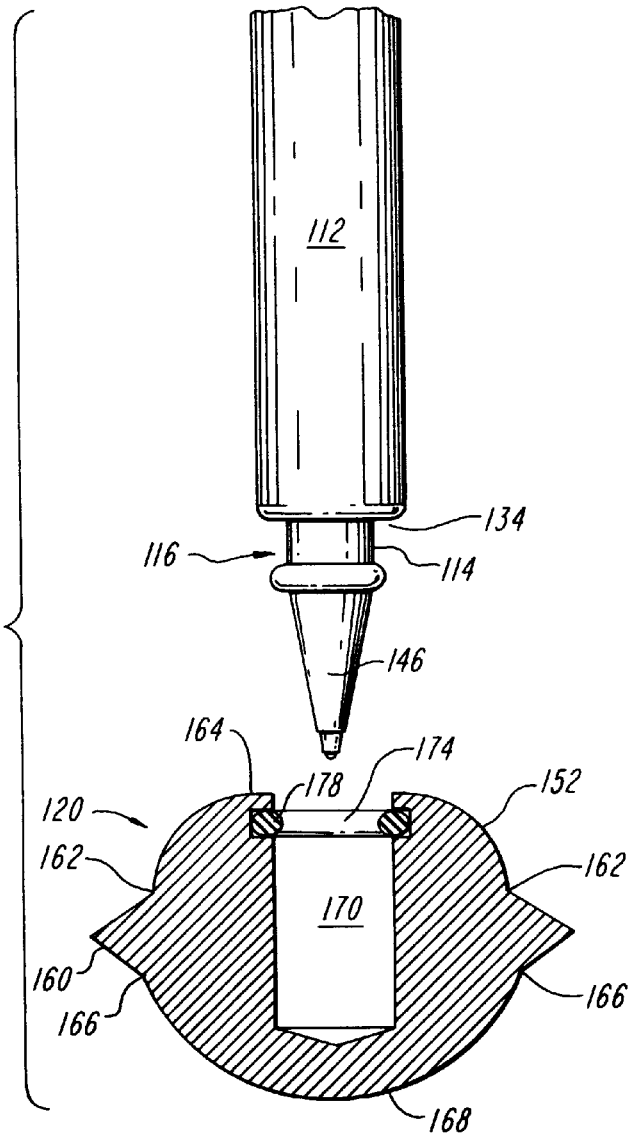
FIG. 8 is a partially cross-sectional side elevational view of a pen according to the second embodiment of the present invention.

When pen 10 is placed on a flat surface at close to a vertical position, such as small angles of up to at least 10–15 degrees from vertical, the weight of bulb 52 forces pen 10 into a standing (vertical) position. Preferably, when cap 20 is placed on a flat surface at any angle it will stand, even if initially placed horizontally. Similarly, it is preferred that pen 10 will remain standing if placed on a flat surface at any angle. From the front, as can be seen in FIG. 1, bulb 52 has an approximately round shape. From the side, as shown in FIGS. 2 and 4, the outer side 62 of bulb 52 has an approximately oval shape.

FIGS. 5–8 show a second embodiment of the invention described above. Characteristics that are the same as with the above embodiment generally are not repeated. Pen 110 includes barrel 112, cartridge 116, and cap 120. Extending from barrel 112 is tip 146. In a preferred embodiment, barrel 112 is approximately 102 mm long, and tip 146 extends approximately 15 mm from the open end 134 of barrel 112. Otherwise, barrel 112, cartridge 116, and tip 146 are similar to the barrel, cartridge, and tip described above. Like the above embodiment, the size can be modified for appearance and as appropriate for the materials used to make the pen.

Cap 120 includes bulb 152, which is encircled by outer ring 160. Preferably bulb 152 and outer ring 160 are formed from a single piece of brass or lead-based brass. Outer ring 160 adds additional mass to cap 120, to improve the ability of pen 110 to remain standing when placed on a flat surface at close to a vertical position. Alternatively, bulb 152 and outer ring 160 could be formed from two pieces or from separate materials. Bulb 152 preferably has a height of approximately 24 mm.

In a preferred embodiment, outer ring 160 has a diameter of approximately 38 mm at its widest, and angles inward to bulb 152. Although shown ending approximately in a point, outer ring 160 could end in a curve, and the straight angles inward also could be replaced with curves.

Above outer ring 160, bulb 152 has a diameter at upper junction 162 of approximately 27.5 mm and curves up to top 164 with a generally bulbous shape. The distance from upper junction 162 to the top 164 of bulb 152 is preferably approximately 9 mm. Although top 164 preferably is flat, the portion of bulb 152 above outer ring 160 could define a continuous curve.

Below outer ring 160, bulb 152 has a diameter at lower junction 166 of approximately 30 mm and curves down to bottom 168, in a generally oval shape. The distance from lower junction 166 to the bottom 168 of bulb 152 is approximately 8.5 mm.

At the top 164 of bulb 152 is drilled a chamber 170, for receiving tip 146. Although chamber 170 preferably is drilled vertically into bulb 152, chamber 170 could, alternatively, extend at an angle into bulb 152. Approximately 1.5 mm from the top of chamber 170 is a recess 174, into which is inserted and affixed a rubber O-ring 178. In a preferred embodiment, O-ring 178 has an outer diameter of 9.5 mm and an inner diameter of 6 mm. O-ring 178 holds tip 146 snugly in cap 120 at crevice 114, from which tip 146 can be removed when pen 110 is to be used. When pen 110 is closed, front end 134 of barrel 112 contacts top 164 of bulb 152.

As with the prior embodiment, when pen 110 is placed on a flat surface at close to a vertical position, such as small angles up to at least 10–15 degrees from vertical, the weights and positions of bulb 152 and outer ring 160 force pen 110 into a standing (vertical) position. Preferably, when cap 120 is placed on a flat surface at any angle it will stand, even if initially placed nearly horizontally. Similarly, it is preferred that pen 110 will remain standing if placed on a flat surface at any angle.

Although the preferred embodiments have been described in terms of a pen, the cap can be used with other writing instruments. Also, the cap can be used with other objects that would otherwise lie relatively flat. The internal plastic lining 18 of tube 50 from the first embodiment can have any appropriate inside shape. Alternatively, lining 18 can be omitted, and the inside of tube 50 shaped to fit a cylindrical or other long and thin object to be inserted into cap 20.

While there have been shown and described examples of the present invention, it will be readily apparent to those skilled in the art that various changes and modifications may be made therein without departing from the scope of the invention as defined by the appended claims. Accordingly, the invention is limited only by the following claims and equivalents thereto.

What is claimed is:

1. A writing instrument comprising:

a barrel having an open end;

a cartridge connected to the barrel, the cartridge having a writing portion extending from the open end of the barrel; and a cap having a front end and a back end, the cap including a tube having an opening at the back end, the opening having a first diameter, and the cap further including a bulb at the front end and connected to the tube, the bulb having a second diameter and an approximately oval front side, wherein the cartridge is removably insertable into the tube and the second diameter is greater than the first diameter, and wherein the bulb has a sufficient mass relative to the rest of the writing instrument that the writing instrument will remain standing when placed bulb-down on a horizontal surface in a close to vertical position, and wherein the barrel does not extend into the tube.

2. The writing instrument of claim 1, wherein the tube further includes an outer portion including a first material and an inner portion including a second material, and the cartridge is removably connectable to the inner portion.

3. The writing instrument of claim 2, wherein the bulb includes brass.

4. The writing instrument of claim 3, wherein the barrel includes resin.

5. The writing instrument of claim 1, wherein the bulb is solid.

6. The writing instrument of claim 5, wherein the tube and the bulb are formed as a single piece.

7. The writing instrument of claim 1, wherein the back end of the cap meets the open end of the barrel when the cartridge is fully inserted into the tube.

8. The writing instrument of claim 7, wherein the diameter of the barrel at the open end is approximately the same as the first diameter.

9. The writing instrument of claim 1, wherein the cartridge is held firmly by the tube when removably inserted into the tube.

10. A cap for a writing instrument, the cap comprising:

a hollow tube having a first diameter, an open first end, and a second end opposite the first end, for removable receipt of a cartridge portion of a writing instrument having a barrel with a diameter sufficiently large that the barrel cannot enter the tube; and a bulb having a second diameter, a third end connected to the second end of the tube, and a fourth end having an approximately oval shape, wherein the second diameter is at least approximately two times the first diameter and the bulb has a sufficient mass relative to the tube that the cap will remain standing when the fourth end is placed on a horizontal surface.

11. The cap of claim 10, wherein the bulb is solid.

12. The cap of claim 10, wherein the bulb includes brass.

13. The cap of claim 11, wherein the cap will stand up when placed in a horizontal position on a horizontal surface.

14. A cap for a writing instrument comprising:

a bulb having an instrument end with a bulbous shape and an approximately oval bottom end, the bulb defining a chamber having an opening at the instrument end for removably receiving a writing instrument, and an outer ring extending outwardly from the bulb between the bulbous instrument end and the approximately oval bottom end, the outer ring having an upper junction with the bulb and having a lower junction with the bulb, the outer ring having a diameter greater than the upper junction and greater than the lower junction, wherein the cap has a sufficient mass that the cap will remain standing when placed bulb-down on a horizontal surface in a close to vertical position.

15. The cap of claim 14, wherein the bulb and the outer ring are formed from a single piece.

16. The cap of claim 15, wherein the bulb and the outer ring include brass.

17. The cap of claim 16, further comprising an O-ring within the chamber for firmly holding a writing instrument when the writing instrument is removably inserted into the cap.

18. The cap of claim 14, wherein the instrument end is opposite the bottom end.

19. The cap of claim 14, wherein the cap will stand up when placed in a nearly horizontal position on a horizontal surface.

20. A writing instrument comprising:

a barrel having an open end;

a cartridge connected to the barrel, the cartridge having a writing portion extending from the open end of the barrel; and a cap including a bulb having an instrument end with a bulbous shape and an approximately oval bottom end, the bulb defining a chamber having an opening at the instrument end for removably receiving the cartridge, the cap further including an outer ring extending from the bulb between the bulbous instrument end and the approximately oval bottom end, the outer ring having an upper junction with the bulb and having a lower junction with the bulb, the outer ring having a diameter greater than the upper junction and greater than the lower junction, wherein the cap has a sufficient mass that the writing instrument will remain standing when placed bulb-down on a horizontal surface in a close to vertical position.

21. The writing instrument of claim 20, wherein the open end of the barrel meets the instrument end of the cap when the cartridge is fully inserted into the chamber.

22. The writing instrument of claim 20, wherein the cartridge is held firmly by the bulb when removably inserted into the bulb.

* * * * *